US010704366B2

(12) United States Patent
Turner

(10) Patent No.: US 10,704,366 B2
(45) Date of Patent: Jul. 7, 2020

(54) METHOD AND APPARATUS FOR INSTALLING A LINER AND BRIDGE PLUG

(71) Applicant: Don Turner, Lloydminster (CA)

(72) Inventor: Don Turner, Lloydminster (CA)

(73) Assignee: RENOWN DOWN HOLE SOLUTIONS INC., Lloydminster, Alberta (CA)

( * ) Notice: Subject to any disclaimer, the term of this patent is extended or adjusted under 35 U.S.C. 154(b) by 685 days.

(21) Appl. No.: 14/667,758

(22) Filed: Mar. 25, 2015

(65) Prior Publication Data

US 2015/0275630 A1 Oct. 1, 2015

(30) Foreign Application Priority Data

Apr. 1, 2014 (CA) ..... 2847780

(51) Int. Cl.
*E21B 43/10* (2006.01)
*E21B 33/134* (2006.01)

(52) U.S. Cl.
CPC ..... *E21B 43/10* (2013.01); *E21B 33/134* (2013.01)

(58) Field of Classification Search
CPC ..... E21B 33/134; E21B 33/12; E21B 43/10; E21B 23/02; E21B 43/08; E21B 43/11855
See application file for complete search history.

(56) References Cited

U.S. PATENT DOCUMENTS 4,671,358 A * 6/1987 Lindsey, Jr. ..... E21B 33/16 166/154
4,842,069 A 6/1989 Baugh et al.
5,181,570 A * 1/1993 Allwin ..... E21B 43/10 166/208
5,275,242 A 1/1994 Payne
5,704,426 A * 1/1998 Rytlewski ..... E21B 23/00 166/297
5,833,004 A 11/1998 Coronado
6,142,226 A * 11/2000 Vick ..... E21B 21/10 166/120
6,318,472 B1 * 11/2001 Rogers ..... E21B 23/04 166/208
6,378,610 B2 * 4/2002 Rayssiguier ..... E21B 17/003 166/186
7,048,065 B2 5/2006 Badrak et al.
7,438,135 B2 10/2008 Page et al.
(Continued)

FOREIGN PATENT DOCUMENTS

CA 2 309 513 11/2000
CA 2 424 719 10/2004
(Continued)

*Primary Examiner* — Robert E Fuller
*Assistant Examiner* — Lamia Quaim
(74) *Attorney, Agent, or Firm* — Davis & Bujold PLLC; Michael J. Bujold

(57) ABSTRACT

A liner and bridge plug are installed in a hydrocarbon well that has a casing and a section to be lined by the liner. The liner and bridge plug are installed by providing a tubing string that carries a bridge plug and a liner setting tool, the liner setting tool carrying a liner, inserting the tubing string into the hydrocarbon well until the liner is at a desired location along the casing, activating the liner setting tool to install the liner, activating the bridge plug to seal the wellbore and disengaging the tubing string from the bridge plug and the liner.

28 Claims, 13 Drawing Sheets

(56) References Cited

U.S. PATENT DOCUMENTS

| | | | | |
|---|---|---|---|---|
| 7,757,756 | B2 * | 7/2010 | Bullard | E21B 23/06 166/181 |
| 7,874,365 | B2 | 1/2011 | East, Jr. et al. | |
| 8,122,975 | B2 | 2/2012 | Belcher et al. | |
| 2003/0024712 | A1 * | 2/2003 | Neal | E21B 33/134 166/386 |
| 2005/0150659 | A1 * | 7/2005 | Popilian | E21B 43/10 166/380 |
| 2010/0096123 | A1 * | 4/2010 | Hueston | E21B 33/04 166/208 |
| 2010/0252278 | A1 | 10/2010 | Harris et al. | |
| 2010/0319427 | A1 * | 12/2010 | Lohbeck | E21B 43/105 72/54 |
| 2011/0017472 | A1 * | 1/2011 | Maxwell | E21B 33/127 166/380 |
| 2012/0186829 | A1 | 7/2012 | Watson | |
| 2012/0205091 | A1 * | 8/2012 | Turley et al. | E21B 33/1216 166/77.53 |

FOREIGN PATENT DOCUMENTS

| | | | |
|---|---|---|---|
| EP | 1 026 365 | A2 | 8/2000 |
| EP | 1712732 | A1 | 10/2006 |
| EP | 2 020 482 | A2 | 4/2009 |
| GB | 2477427 | | 8/2011 |

* cited by examiner

METHOD AND APPARATUS FOR INSTALLING A LINER AND BRIDGE PLUG

TECHNICAL FIELD

This relates to a liner and bridge plug where both the liner and the bridge plug are installed in a well using a single trip of pipe.

BACKGROUND

In some hydrocarbon producing wells, it is common to install liners in the open well bore section, or the section that is below the casing. This open section may be horizontal or vertical. When installing the liner and bridge plug, conventional drilling and completion methods require a first round trip to install the liner and then another trip to deploy the bridge plug. In the first trip, a liner and liner top are run into the well bore on the pipe set and deployed. The pipe is then pulled back out of the well bore and a retrievable bridge plug is picked up. The pipe, now carrying the bridge plug, is then run back in to the well bore set and deployed, securing the well bore using the bridge plug. The pipe is then pulled back out. The bridge plug may then be pulled out again.

SUMMARY

There is provided a method of installing a liner and a bridge plug in a hydrocarbon well. The hydrocarbon well comprises a first section having a casing and a second section to be lined by the liner. The method comprises the steps of providing a tubing string that carries a bridge plug and a liner setting tool, the liner setting tool carrying a liner; inserting the tubing string into the hydrocarbon well until the liner is at a desired location along, the casing; activating the liner setting tool to install the liner; activating the bridge plug to seal the wellbore; and disengaging the tubing string from the bridge plug and the liner.

According to another aspect, the tubing string may comprise at least one internal valve that is open when the tubing string is inserted into the well.

According to another aspect, the liner may comprise a liner top, and the liner setting tool may engage the liner top.

According to another aspect, the liner top may comprise a liner seal that seals between the outer surface of the liner and the casing.

According to another aspect, the liner top may be activated by a liner top setting tool carried by the installation tool.

According to another aspect, the liner setting tool may be hydraulically or mechanically operated.

According to another aspect, the bridge plug may be activated by a bridge plug setting tool carried by the installation tool.

According to another aspect, the bridge plug may be activated hydraulically or mechanically.

According to another aspect, the bridge plug may be carried above the liner and engage the casing string when activated.

According to another aspect, the liner setting tool may remain attached to the bridge plug after the bridge plug has been activated.

According to another aspect, the method may further comprise the step of disengaging the liner setting tool from the liner after activating the liner top and prior to activating the bridge plug.

According to another aspect, the bridge plug may be carried within the liner and may seal the liner when activated.

According to another aspect, the bridge plug may be set inside the liner prior to inserting the tubing string into the hydrocarbon well, and may have a valve that is open when the tubing string is inserted into the hydrocarbon well and closed when the liner setting tool is disconnected and withdrawn from the liner.

There is provided, according to an aspect, an apparatus for installing a liner and a bridge plug in a hydrocarbon well, the hydrocarbon well having an upper section comprising a casing and a lower section to be lined. The apparatus comprises a running tool having a tubing string attachment, a liner activator, and a bridge plug activator; a liner carried by the running tool, the liner having a running state and a set state, the liner activator selectively changing the liner from the running state to the set state to install the liner in the hydrocarbon well; and a bridge plug carried by the running tool, the bridge plug having a running state and a sealed state, the bridge plug activator selectively changing the bridge plug from the running state to the sealed state to seal the hydrocarbon well by the liner setting tool.

According to another aspect, the tubing string attachment may be selectively disconnectable.

According to another aspect, the running tool may comprise a tubular body that has at least one internal seal that is selectively openable.

According to another aspect, the liner activator and the bridge plug activator are each either hydraulically or mechanically operated.

According to another aspect, the liner may comprise a liner top, and the running tool may engage the liner top.

According to another aspect, the liner top may comprise a liner seal that seals between the outer surface of the liner and the casing.

According to another aspect, the bridge plug may be carried above the liner and may engage the casing string in the sealed state.

According to another aspect, the running tool may remain attached to the bridge plug after the bridge plug has been changed to the sealed state.

According to another aspect, the bridge plug may be carried within the liner and seal the liner when changed to the sealed state.

According to another aspect, the bridge plug may be set against the line prior to inserting the tubing string into the hydrocarbon well, and may have a valve that is open when the tubing string is inserted into the hydrocarbon well and closed when the liner setting tool is disconnected and withdrawn from the liner.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

A method of installing a liner and a retrievable bridge plug will now be described. The method as described only requires one round trip of pipe into the wellbore in order to install both the liner system and the bridge plug. In the description below, the term bridge plug is used to describe a tool that isolates the lower part of a wellbore. The bridge plug may take various forms and may include, for example, various styles of packers or other types of seals. It will be understood that the term "bridge plug" is intended to cover the various types of plugs, packers or seals that may be used in well suspension or completion operations. The bridge plug may be used to seal off a well bore from an open zone or formation, or to seal off an exposed portion of the wellbore. A typical liner system may include a liner top, carrying the activator and other components, and a wellbore liner that extends below the liner top. As the liner may be in various configurations, the description below relates to a liner system that will merely be referred to as a liner, and it will be understood that this includes liner systems with a liner top and a liner section that extends below the liner top. For example, in one embodiment described below, the bridge plug is be carried within the liner, and it will be understood that this includes bridge plugs that may be positioned within a liner top.

Figure 1:
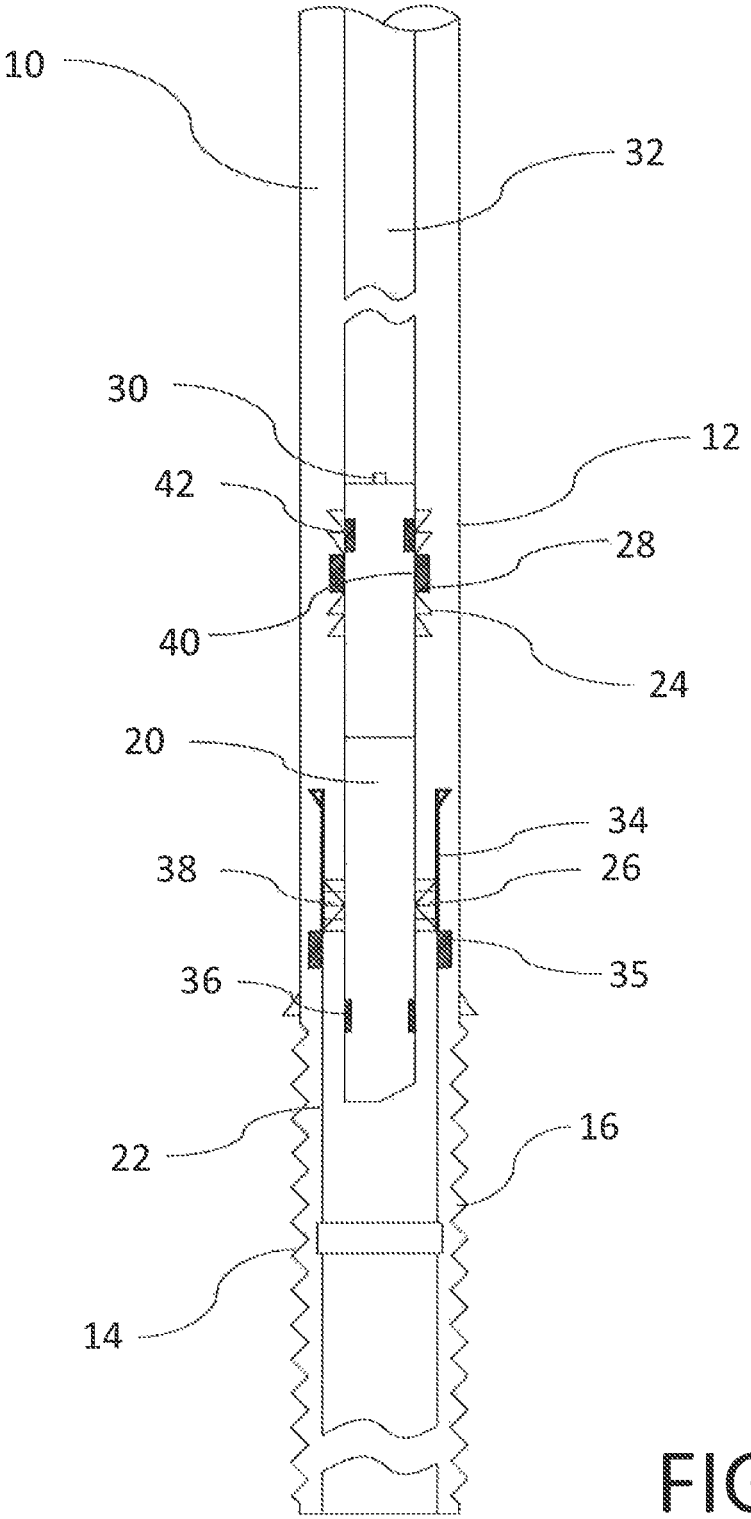
FIG. 1 is a schematic view of a wellbore in which the liner is positioned downhole.

Referring now to FIG. 1, there is shown a wellbore 10 having a casing string 12 and a wellbore portion 14 to be lined. Casing 12 is the tubing string that defines the upper section of the wellbore pipe to which the liner and bridge plug are to be attached. The portion 14 to be lined will generally be an open hole section 16, but may also be cased in some circumstances, and may include any vertical or horizontal section that is to be lined with a liner, such as production pipe or other types of liners. As will be understood, the methods described below may be applied to different wells with different configurations that are commonly lined and plugged using conventional approaches. Those of ordinary skill will appreciate how the presently described method and apparatus may be modified to suit the particular circumstances encountered.

There will now be described two embodiments of the method and apparatus. The first embodiment is shown in FIG. 1-5 and has a bridge plug carried above the liner. The second embodiment is shown in FIG. 6-11 and has a bridge plug carried within the liner. In the first embodiment, the bridge plug seals the borehole above the liner, while in the second embodiment, the bridge plug seals the inside of the liner, and a liner seal seals between the liner and the borehole. In both embodiments, the bridge plug acts to seal the borehole when engaged.

With respect to the first embodiment, referring to FIG. 1, a tubing string 32 carries a liner string 22 and a bridge plug 24. In the depicted embodiment, tubing string 32 has an installation tool 20 at its downhole end that is attached to both liner string 22 and bridge plug 24. It will be understood that liner string 22 and bridge plug 24 may be carried by tubing string 32 in different ways, although it is necessary to provide a method of activating liner string 22 and bridge plug 24, as will be understood from the discussion below. As shown, installation tool 20 has a liner setting tool 26 that attaches to liner string 22, or preferably, a liner top 34 of liner string 22. Liner top 34 may be integrally formed with liner string 22 and may be any known type of liner top 34 that may be set as will be described below. Installation tool 20 also preferably has a seal carrier 28 that attaches to bridge plug 24. Alternatively, installation tool 20 and seal carrier 28 may be considered part of bridge plug 24. In the depicted embodiment, installation tool 20 is connected to tubing string 32 by a releasable connector 30, which allows installation tool 20 to be lowered and manipulated downhole and then released to allow installation tool 20, which carries bridge plug 24, to remain downhole as the tubing string 32 is withdrawn. Installation tool 20 may also be considered a releasing tool, as it is used to release liner string 22 at a desired location within wellbore 10. As will be understood, liner top 34 is used to hang or otherwise support liner string 22 in wellbore 10. Liner top 34 may take various forms as will be recognized in the art, and may include packers, sealing elements, slips, dogs, etc. that are sufficient to properly support liner string 22.

Referring to FIG. 1, liner top 34 has a support element 35 that preferably also acts as a seal, such as a packer or other type of sealing device. Support element 35 is shown schematically as a single component, although it will be understood that there may be multiple support elements 35, or separate components that perform the different functions of support element 35. Support element 35 of liner top 34 is carried on an outer surface of liner string 22. Installation tool 20 is lowered to a depth that allows liner string 22 to be installed at the desired position. Generally speaking, this will be toward the bottom of casing 12 such that liner string 22 overlaps the open hole portion 16 of wellbore 10. Once in position, liner top 34 is activated such that it engages casing 12 to suspend liner string 22 by liner top 34. Liner string 22 will generally be production tubing, such as perforated or slotted tubing, but other suitable types of liners may also be used as will be recognized by those skilled in the art. Liner string 22 may be made up of many sections or in a single piece. Liner top 34 may be actuated by various known techniques, which will generally be hydraulic or mechanical, and is at least partially incorporated into installation tool 20 as a liner setting tool 26, whether it be as a mechanical component, or fluid ports that permit hydraulic fluid to activate liner top 34.

Figure 2:
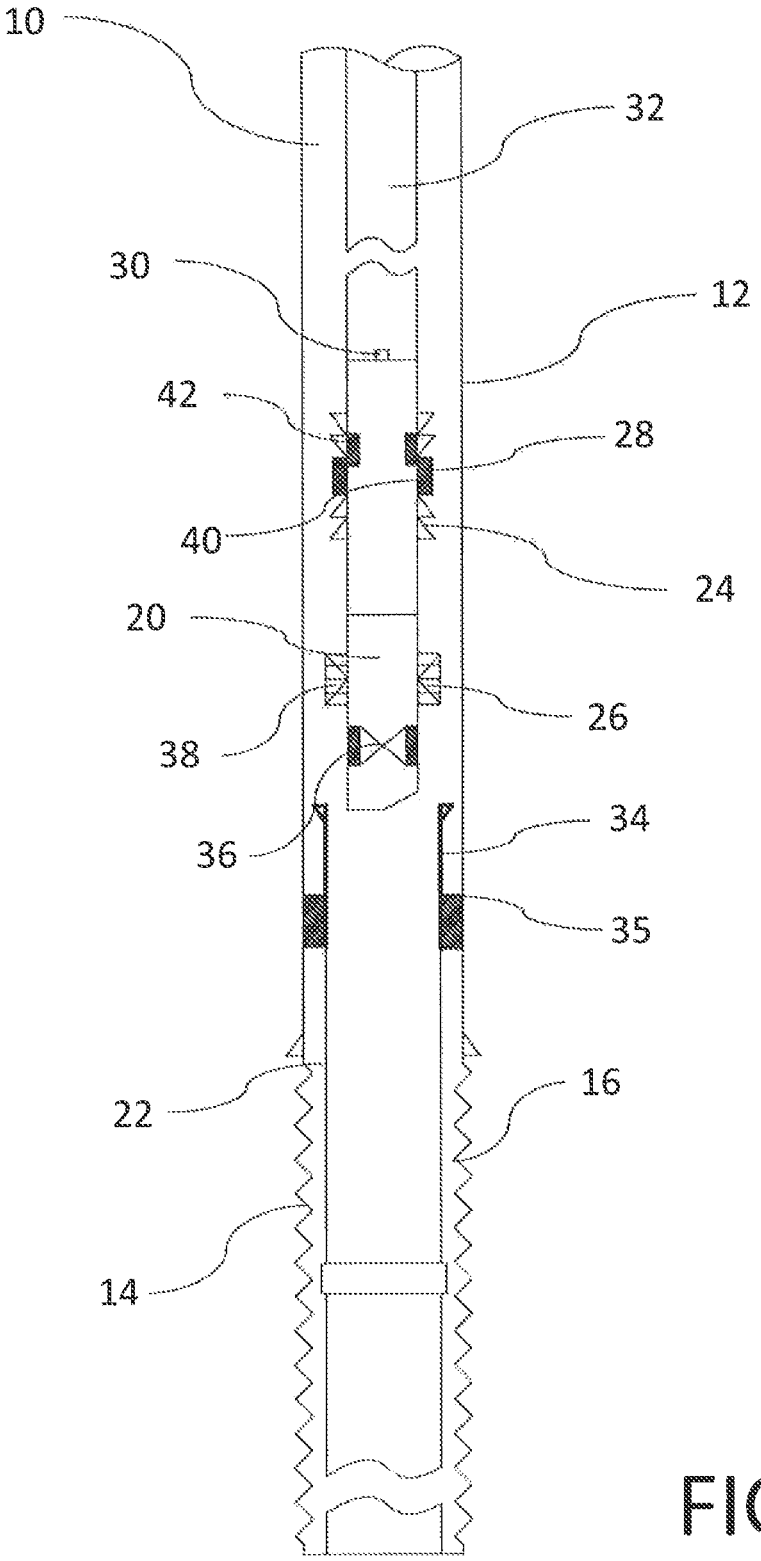
FIG. 2 is a schematic view of a wellbore in which the liner is set and disconnected from the installation tool.

Referring to FIG. 2, once liner string 22 is installed, installation tool 20 may be detached from liner string 22, which no longer requires installation tool 20 as it is being supported by liner top 34. Installation tool 20 or bridge plug 24 may have a valve 36 that can be closed to isolate installation tool 20. If liner top 34 is hydraulically set, valve 36 may be closed to allow pressure to be applied to liner top 34. Valve 36 may be left open when running in or lifting tubing string to prevent any fluid resistance and is then closed when setting bridge plug 24 on order to isolate the well.

Figure 3:
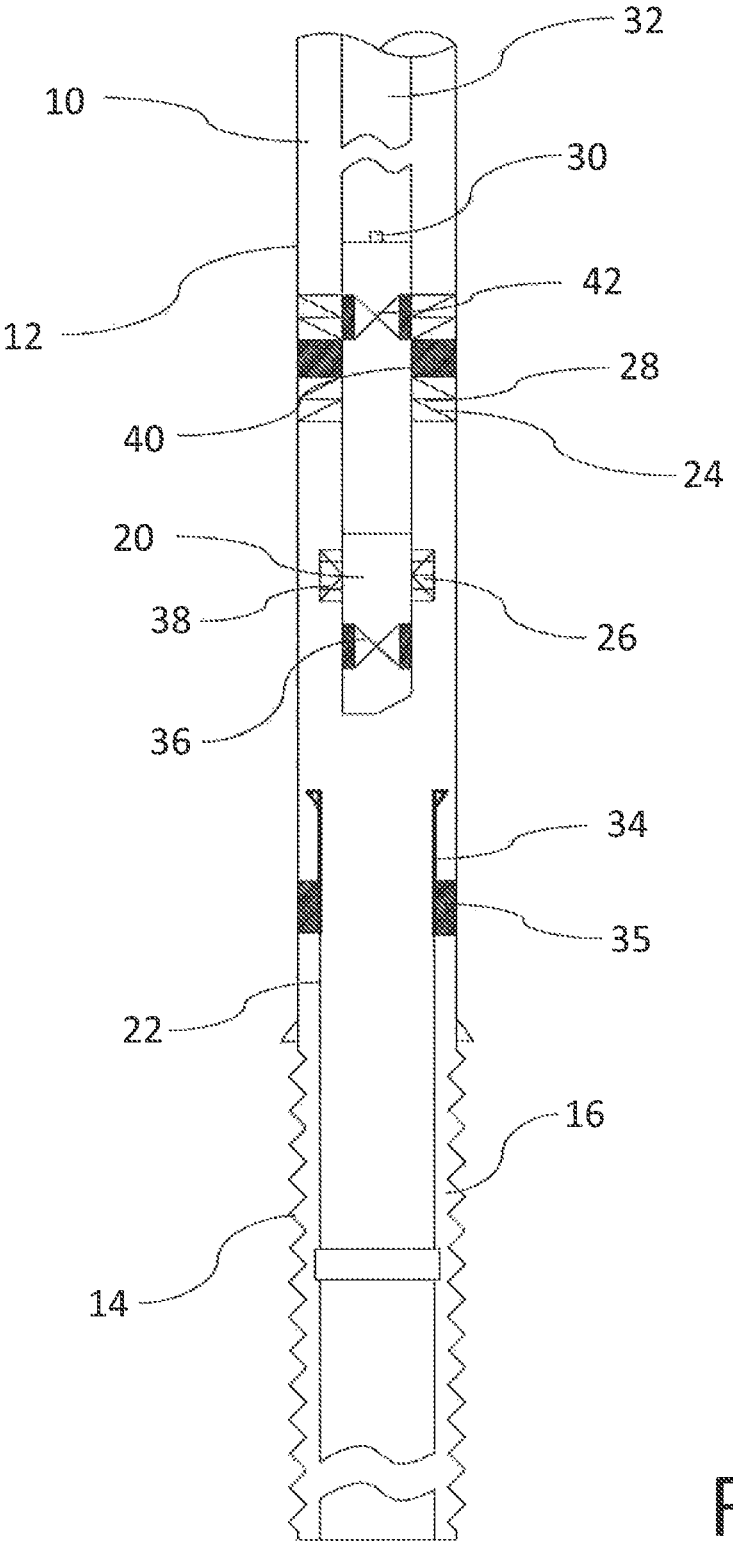
FIG. 3 is a schematic view of a wellbore in which the bridge plug is set.

Referring to FIG. 3, once installation tool 20 is disconnected from liner top 34 and liner string 22, installation tool 20 may be lifted above liner string 22 to prevent interference, and bridge plug 24 is set using a bridge plug setting tool 40 carried by installation tool 20. As noted previously, this is done without having to make two trips with tubing string 32. As with liner setting tool 26 bridge plug setting tool 40 may be activated using various known techniques, such as by providing ports that allow hydraulic fluid to be applied to bridge plug 24, or by providing a mechanical component that acts on bridge plug 24 to set it. In the depicted example bridge plug 24 is mechanically set, however, other methods, such as a ball drop method, may also be used. Bridge plug 24 is preferably retrievable such that the well can be accessed at a later period for continued operations. There are various was of installing bridge plug 24, and it will be apparent to a person of ordinary skill how suitable approaches may be incorporated into installation tool 20. Installation tool 20 may also include an upper valve 42 above valve 36 that can be closed to seal off the inner bore of installation tool 20. Upper valve 42 may also play a role with respect to setting bridge plug 24, if it is hydraulically set.

Figure 4:
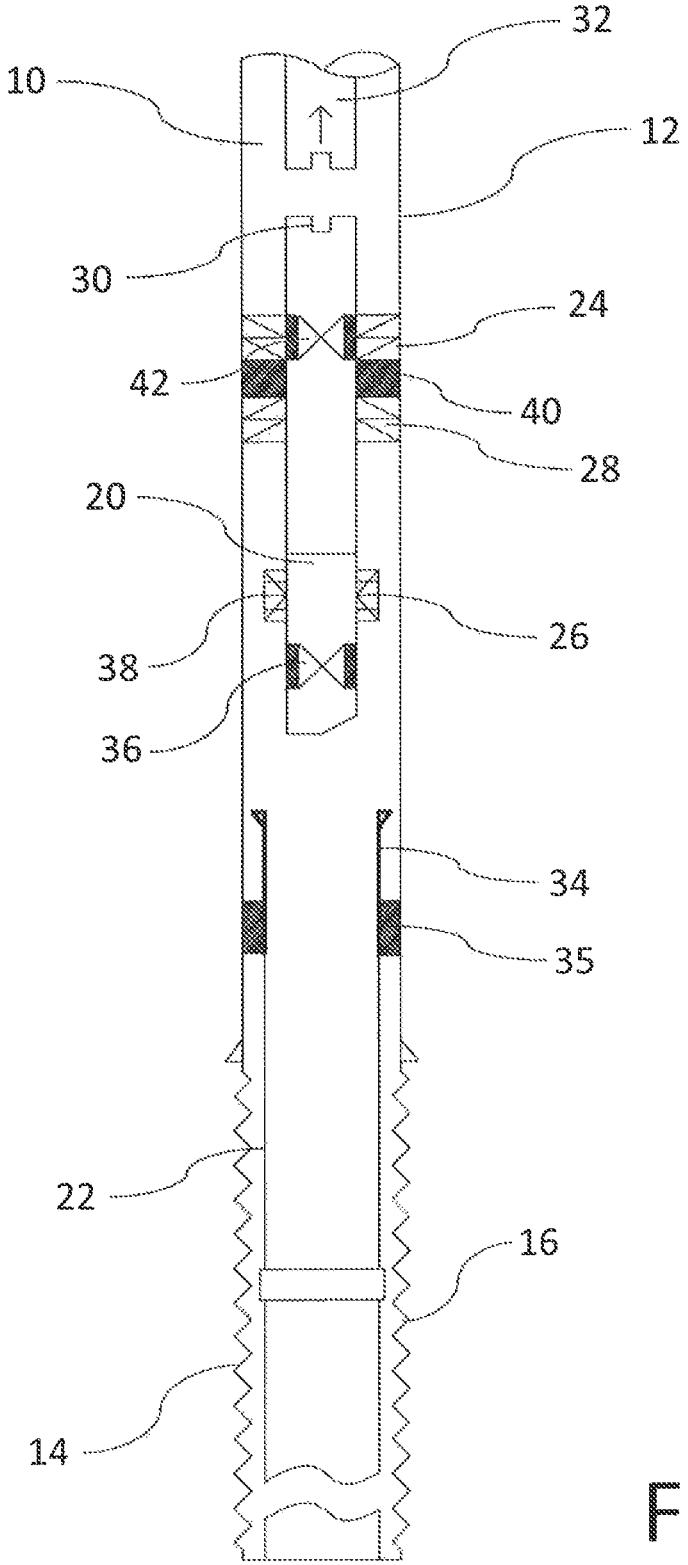
FIG. 4 is a schematic view of a wellbore in which the tubing string is disconnected from the bridge plug and installation tool.
Figure 5:
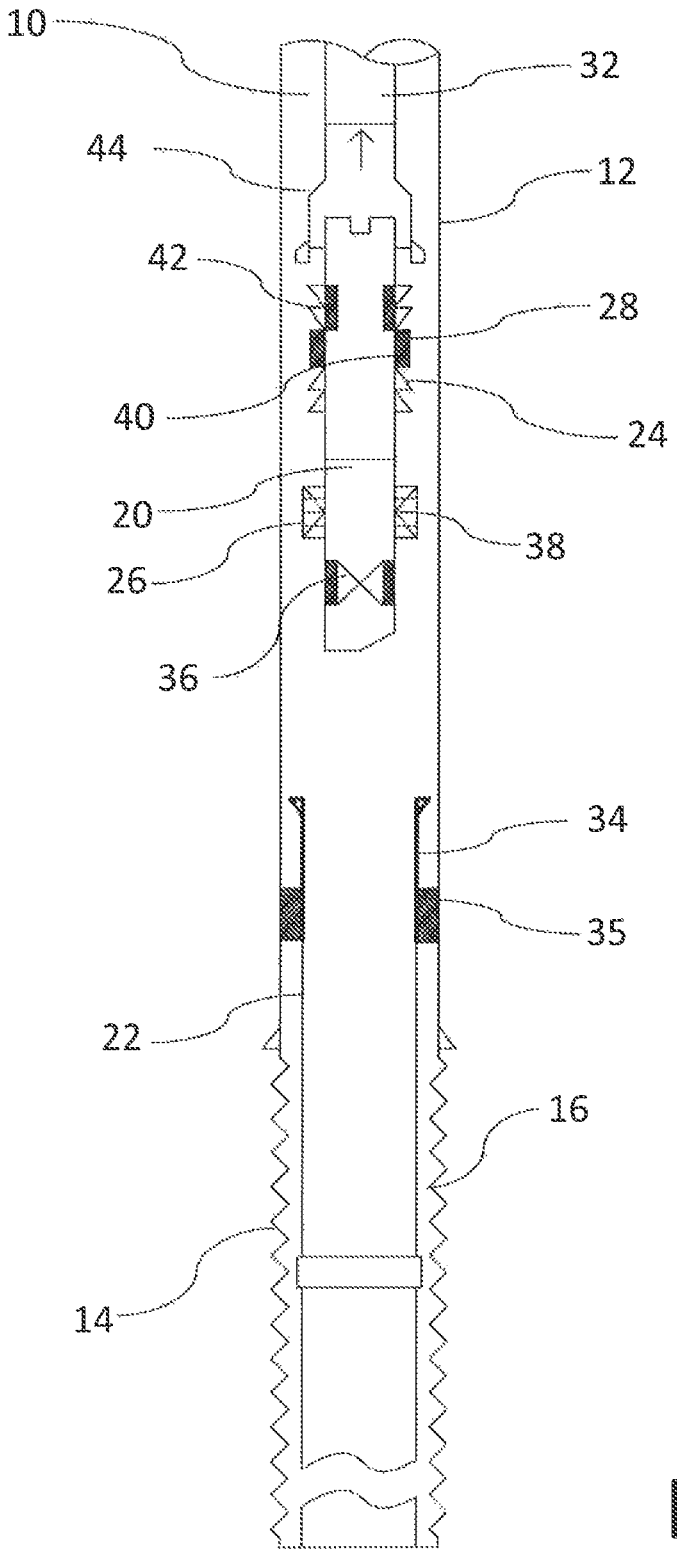
FIG. 5 is a schematic view of a wellbore in which a retrieval tool releases and retrieves the bridge plug and installation tool.

Referring to FIG. 4, once bridge plug 24 is set and upper valve 42 and bottom valve 36 are closed, the wellbore below installation tool 20 is effectively plugged. Tubing string 32 can then be disconnected from installation tool 20 and removed from wellbore 10. Referring to FIG. 5, wellbore 10 may be reopened when desired by releasing and retrieving bridge plug 24 along with installation tool 20 using a removal tool 44. The way in which bridge plug 24 is released will depend on the type of bridge plug being used, and removal tool 44 will be designed accordingly, as is known in the art.

Figure 6:
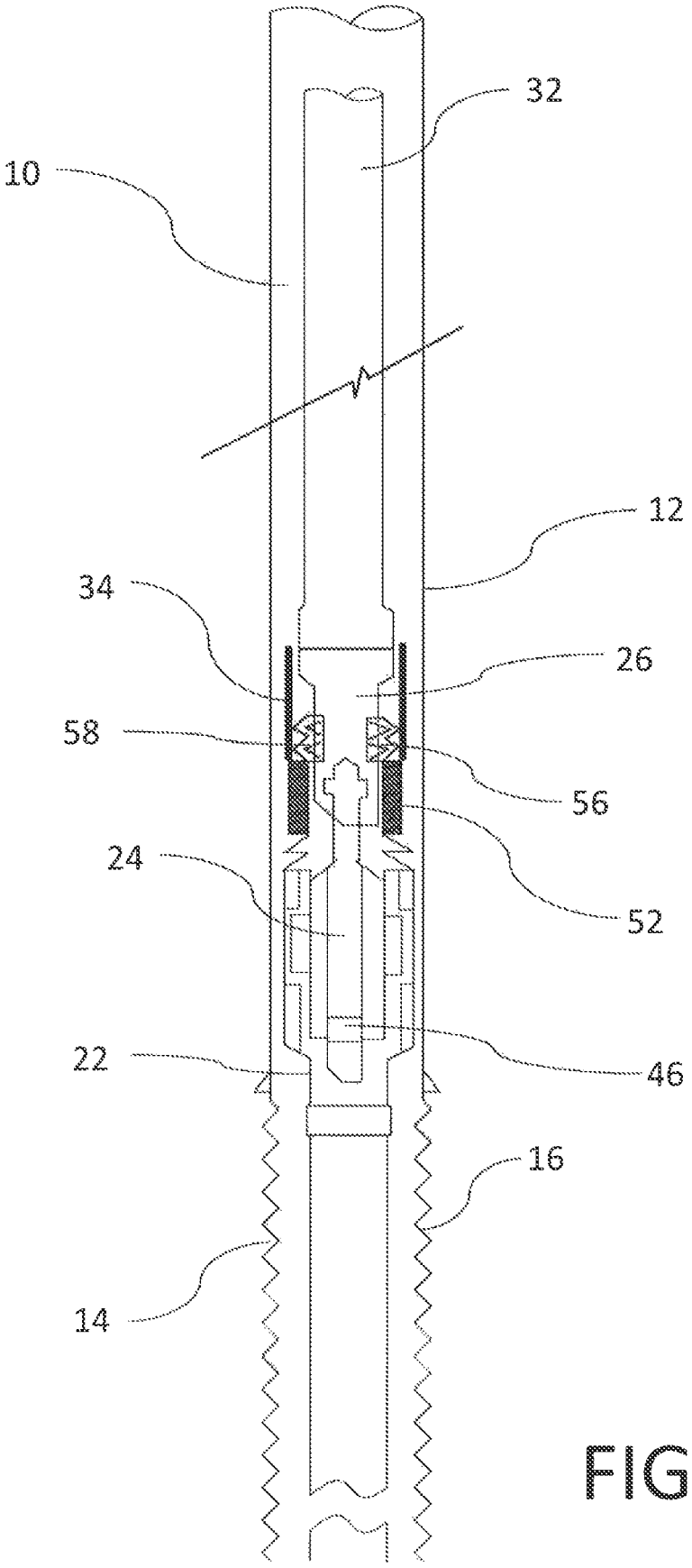
FIG. 6 is a schematic view of a wellbore with a second embodiment of a liner being positioned downhole.
Figure 7:
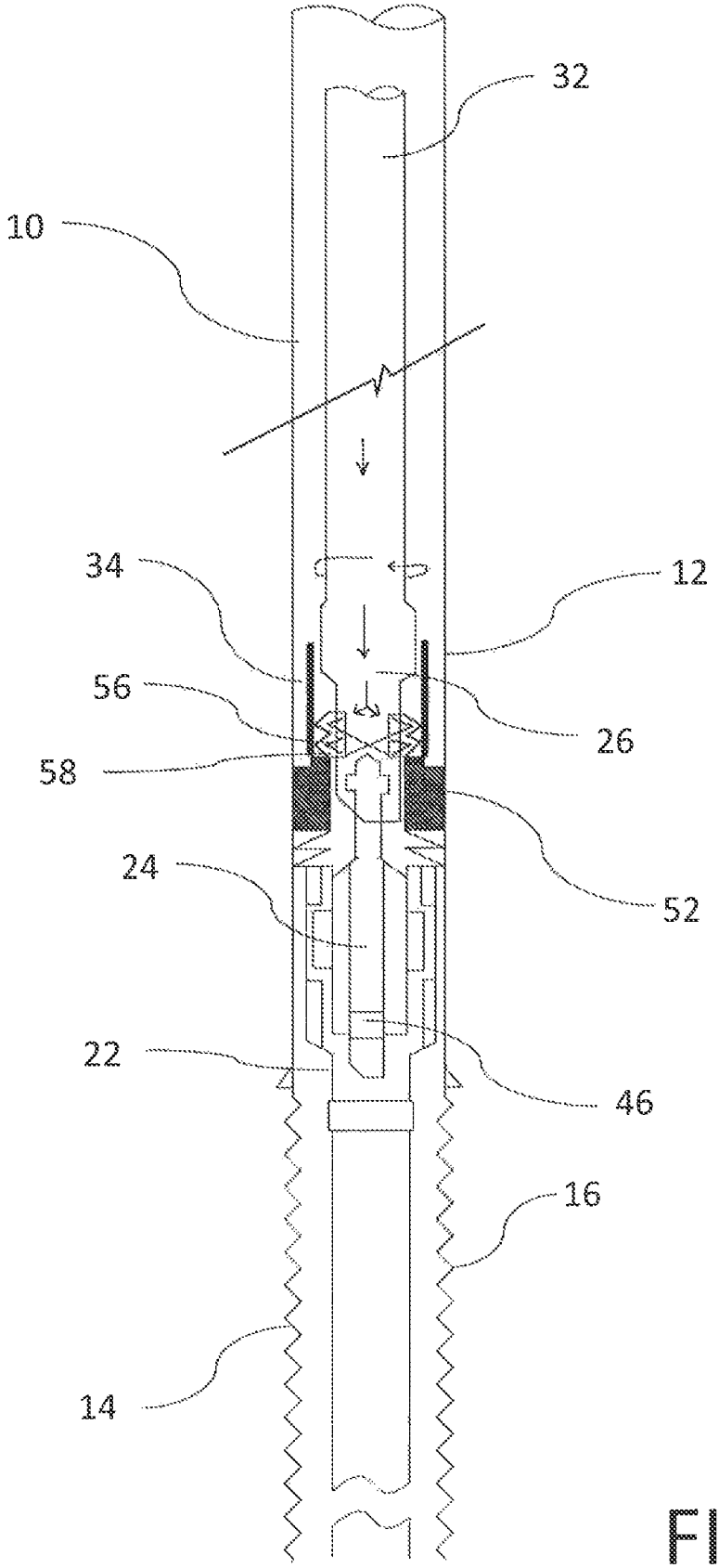
FIG. 7 is a schematic view of a wellbore with a second embodiment of a liner top being set and a liner seal being activated.
Figure 8:
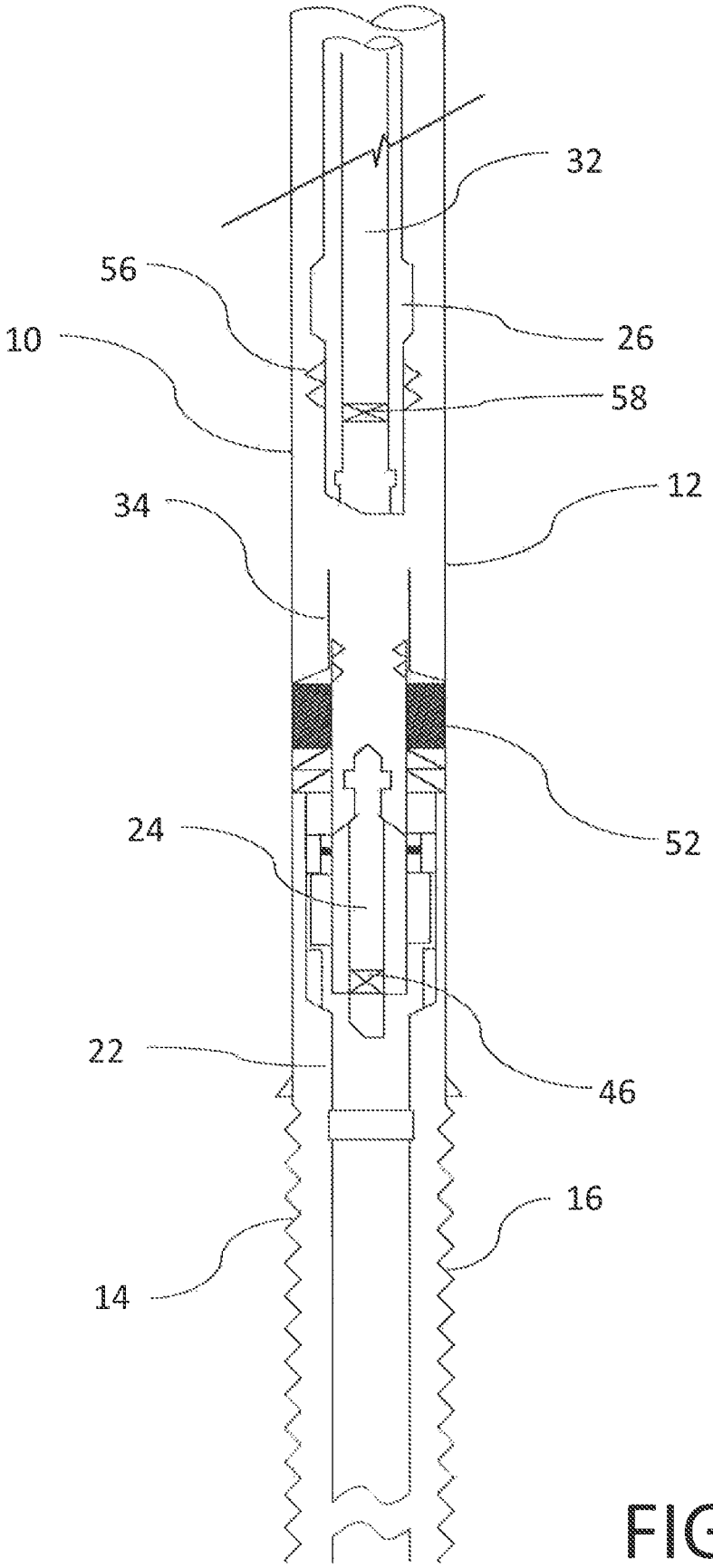
FIG. 8 is a schematic view of a wellbore with a second embodiment of an activating tool being removed from a well with the bridge plug being activated.

Referring to FIG. 6, a second embodiment will be described. As discussed previously, the wellbore. 10 has a first section having a casing 12 and a second section to be lined 14 that is generally an open hole section 16. The tubing string 32 carries a bridge plug 24 and a liner setting tool 26, and the liner setting tool 26 operatively engages a liner 22 using tubing string attachment 56. It will be understood that similar considerations described above will also apply to this second embodiment. The various elements may also be similar to those described above, however it will be understood by those skilled in the art that some changes may be necessary depending on the precise implementation. In this embodiment, the tubing string 32 is inserted into the wellbore 10 until the liner 22 is at a desired location along the casing 12. At this point, referring to FIG. 7, the liner setting tool 26 is activated using one of the methods known in the art in order to install the liner 22. Liner setting tool 26 preferably engages a liner top 34 of liner 22. In this second embodiment, bridge plug 24 is carried inside the liner 22. In order to seal the wellbore 10, the liner top 34 therefore carries a liner seal 52 that seals between the outer surface of liner 22 and casing 12. Liner top 34 and liner seal 52 can be activated by liner setting tool 26 carried by tubing string 32. This activation process may be done with any technique known in the art, for example, mechanically or hydraulically, such as with a ball drop method. Referring to FIG. 8, once liner seal 52 has sealed between liner 22 and casing 12, bridge plug 24 is then activated within liner 22 in order to seal the liner 22 and thereby to seal the wellbore 10. In this embodiment, bridge plug 24 may be set against the inner surface of liner 22 prior to running in tubing string 32, and may allow flow by providing an inner valve 46 that remains open while bridge plug 24 is connected to tubing string 32, and doses when tubing string 32 is disconnected or withdrawn. As shown, liner top 34 is designed to receive bridge plug 24 without sacrificing the inner diameter of liner 22 when bridge plug 24 has been removed. Bridge plug 24 may be sealed by removing a stinger (not shown) that is carried by tubing string 32 and holds an inner valve 46 open when connected, such that when tubing string 32 is withdrawn, the removal of the stinger allows valve 46 to close. Alternatively, bridge plug 24 may be merely supported in place and activated against liner 22 once properly positioned. As with liner setting tool 26, bridge plug 24 may be activated hydraulically, mechanically, or using any other technique known in the art. Once bridge plug 24 is activated, tubing string 32 is disengaged from bridge plug 24 and liner 22. When the tubing string 32 is disengaged from the bridge plug 24, the liner setting tool 26 may remain attached to the bridge plug 24. As bridge plug 24 is installed within liner 22, it acts with liner seal 22 to seal casing 12 at the desired location.

Figure 9:
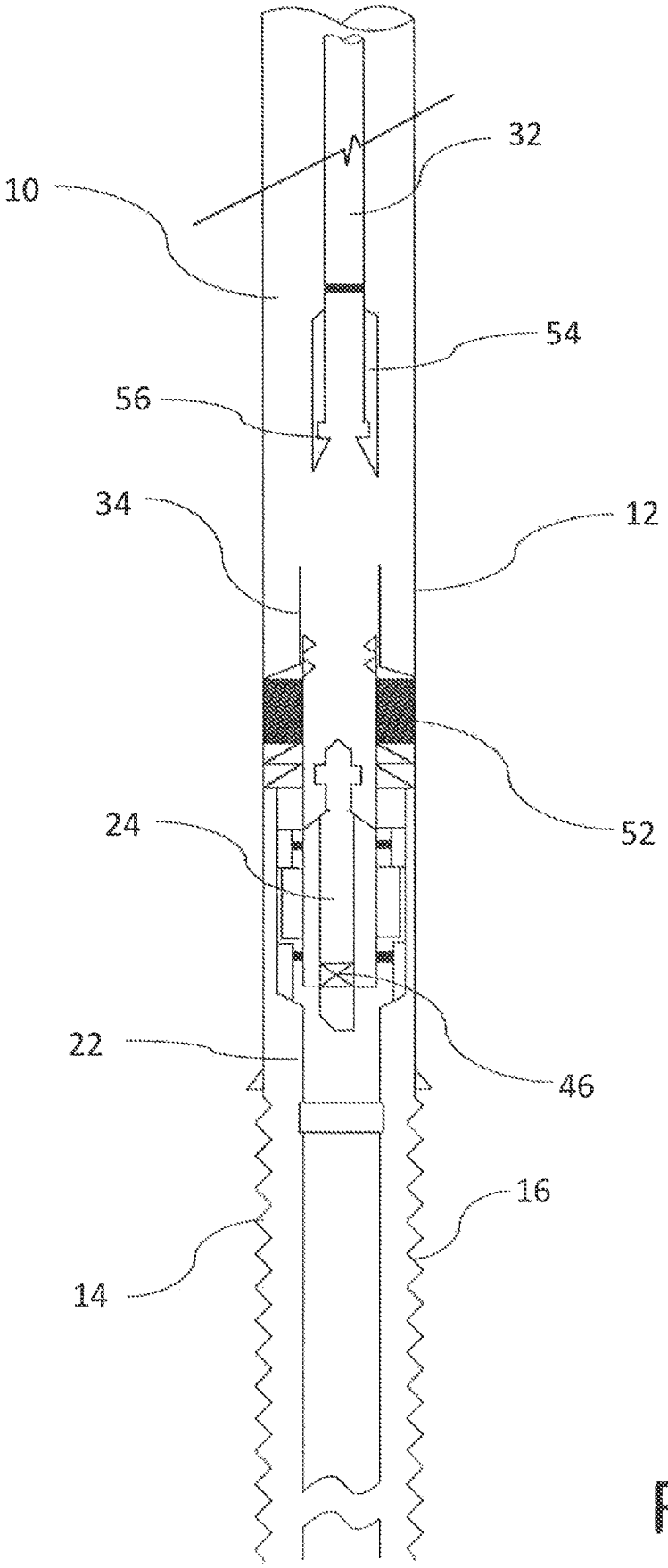
FIG. 9 is a schematic view of a wellbore with a second embodiment of a retrieving tool retrieving the bridge plug.
Figure 10:
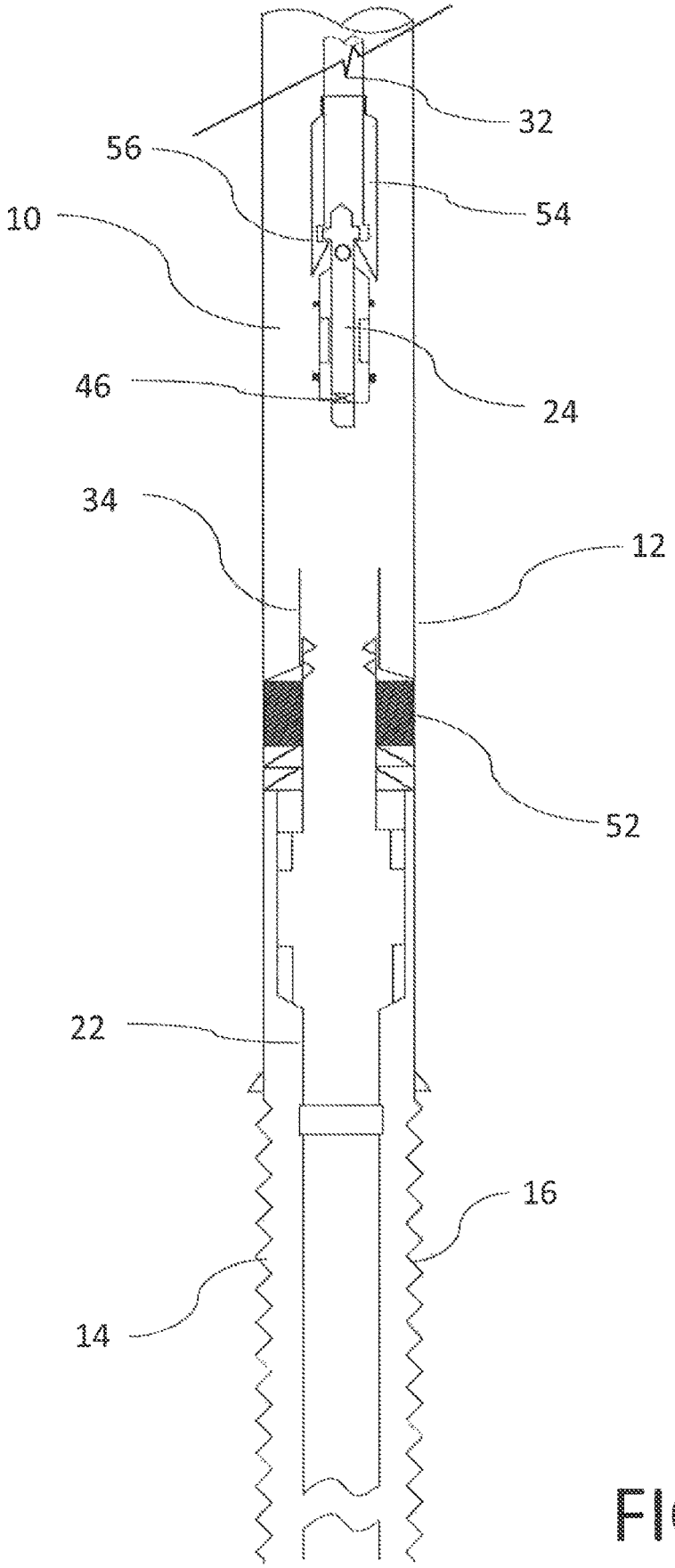
FIG. 10 is a schematic view of a wellbore with a second embodiment of a retrieving tool and bridge plug being removed from a well.

As mentioned, bridge plug 24 is preferably retrievable, although it is also possible to set permanent plugs. Referring to FIG. 9, a retrieval tool 54 is shown that has a bridge plug engagement end 56 that engages and releases bridge plug 24, as shown in FIG. 10. As shown, bridge plug 24 is collapsed and withdrawn from liner 22. This may be done using known techniques and will depend on the design of bridge plug 24. A similar retrieval tool may be used with respect to the first embodiment.

The tubing string of either the first or the second embodiment may have at least one internal valve 50 that is preferably open when the tubing string is inserted into the well. As well, installation tool 20, which preferably comprises a tubular body, preferably has at least one internal seal 58 that is selectively openable. As mentioned above, in some situations it is desired for the liner setting tool 26 to remain attached to the bridge plug 24 when the tubing string 32 is removed. As this may not always be the case, it is preferred for the tubing string attachment 56 between the liner 22 and the liner setting tool 26 to be selectively disconnectable. In either embodiment, the bridge plug 24 and the liner 22 need not be actuated by separate liner setting tool 26 and bridge plug setting tool 40, as liner setting tool 26 may incorporate bridge plug setting tool 40 such that the liner 22 is installed in the wellbore 10 by the liner setting tool 26 and the bridge plug is actuated either to the casing 12 or the liner 22 by the liner setting tool 26 as well.

Figure 11:
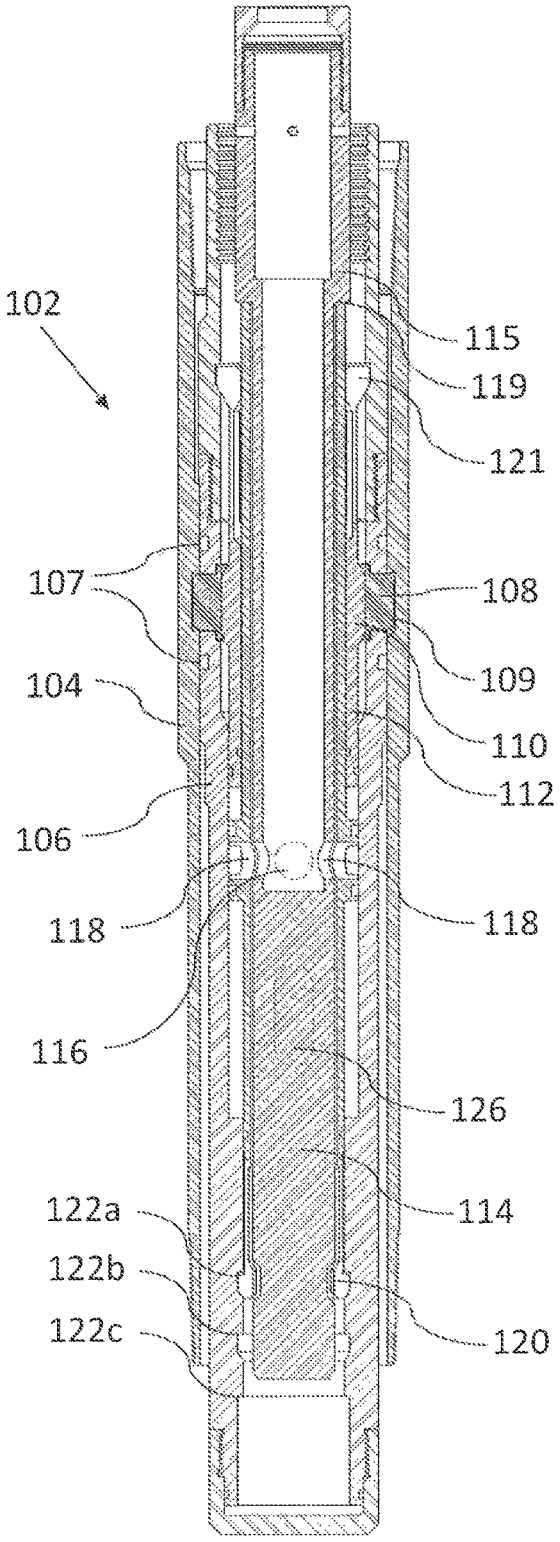
FIG. 11 is a side elevation view of a bridge plug in a running position.

Referring now to FIG. 11-15, another example of a bridge plug, generally indicated by reference number 102, is shown. In FIG. 11, bridge plug 102 is in the running position. Bridge plug 102 has an outer tubular body 104 that is intended to engage with a liner (not shown) and houses a plugging element 106 that seals against an inner surface of outer tubular 104 using seals 107 as shown. Plugging element 106 is secured in place by a series of dogs 108 that engage with a groove 109 in outer tubular body 104. Dogs 108 are held in place by a shoulder 110 on an inner sleeve 112. As will be described, plugging element 106 can be released by moving inner sleeve 112, allowing dogs 108 to retract. An activation member, made up of a first activation tubular 114 and a second activation tubular 115 nested within first activation tubular 114, is carried within inner sleeve 112. Activation tubulars 114 and 115 move bridge plug 102 from the running position shown in FIG. 11 to the sealing position shown in FIG. 12 when downward pressure is applied by the running tool (not shown).

Figure 12:
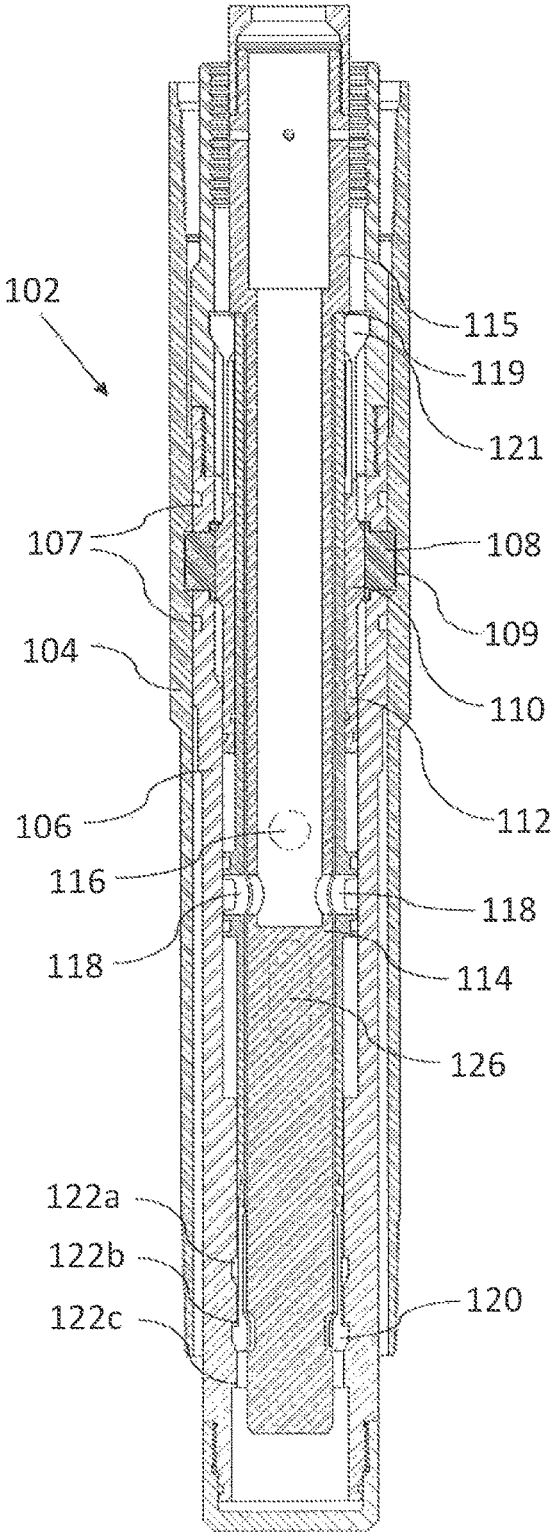
FIG. 12 is a side elevation view of a bridge plug in a sealed position.

As can be seen, plugging element 106 has ports 116 that, when aligned with ports 118 on activation tubulars 114 and 115, allow fluid to flow from within the liner below bridge plug 102 into the interior of bridge plug 102. This allows bridge plug 102 to be run into a well that may be filled within fluid, and is shown in FIG. 11. Once in the desired position, the liner (not shown) will be set and bridge plug 102 will be moved to the sealing position shown in FIG. 12. This is done by shifting activation tubulars 114 and 115 downward, such that ports 118 are no longer aligned with ports 116. This effectively seals the fluids below bridge plug 102 and within the liner. As can be seen, first activation tubular 114 is generally held in place by fingers 120 that engage one of groove 122*a*, groove 122*b*, and shoulder 122*c* formed in the inner surface of plugging element of 106. Referring to FIGS. 11 and 12, first activation tubular 114 is shifted downward upon application of a sufficient force to disengage fingers 120 from groove 122*a* and down to groove 122*b*. With second activation tubular 115 installed, the movement of first activation tubular 114 is limited to an intermediate position due to the engagement between a shoulder 119 carried by second activation tubular 115 and the top surface of releasable collar 121, such that any downward force will be applied to releasable collar 121 rather than first activation tubular 114. Tubulars 114 and 115 are shifted by using a setting tool (not shown), which may operate based on various known principles used to activate and control downhole tools, such as by using mechanical force or hydraulic pressure.

Figure 13:
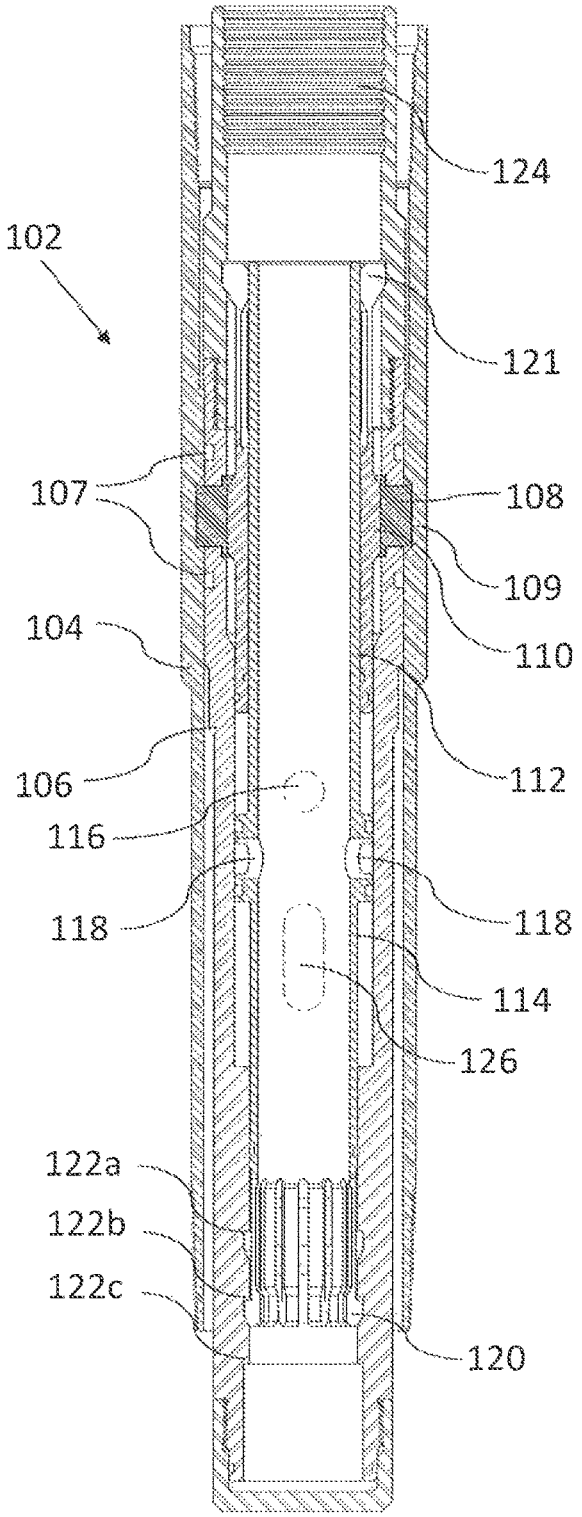
FIG. 13 is a side elevation view of a bridge plug in a sealed position with the second activation tubular removed.
Figure 14:
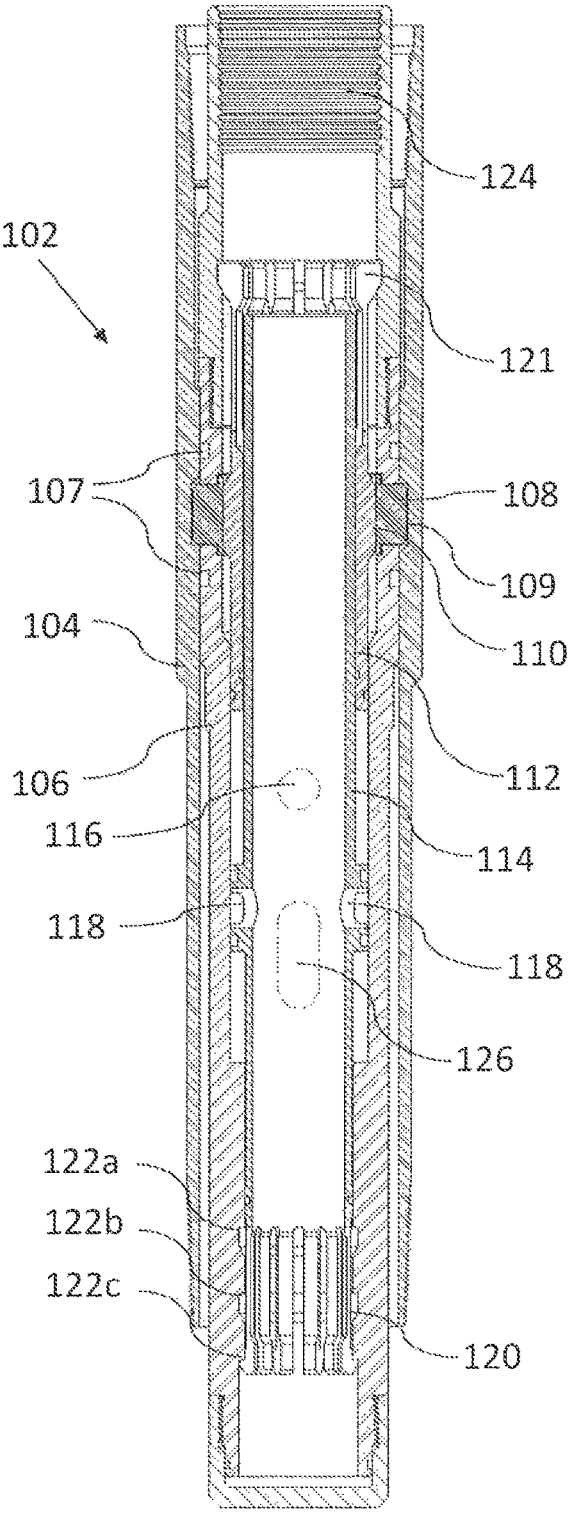
FIG. 14 is a side elevation view of a bridge plug in a sealed position with the second activation tubular removed and the first activation tubular allowing flow.
Figure 15:
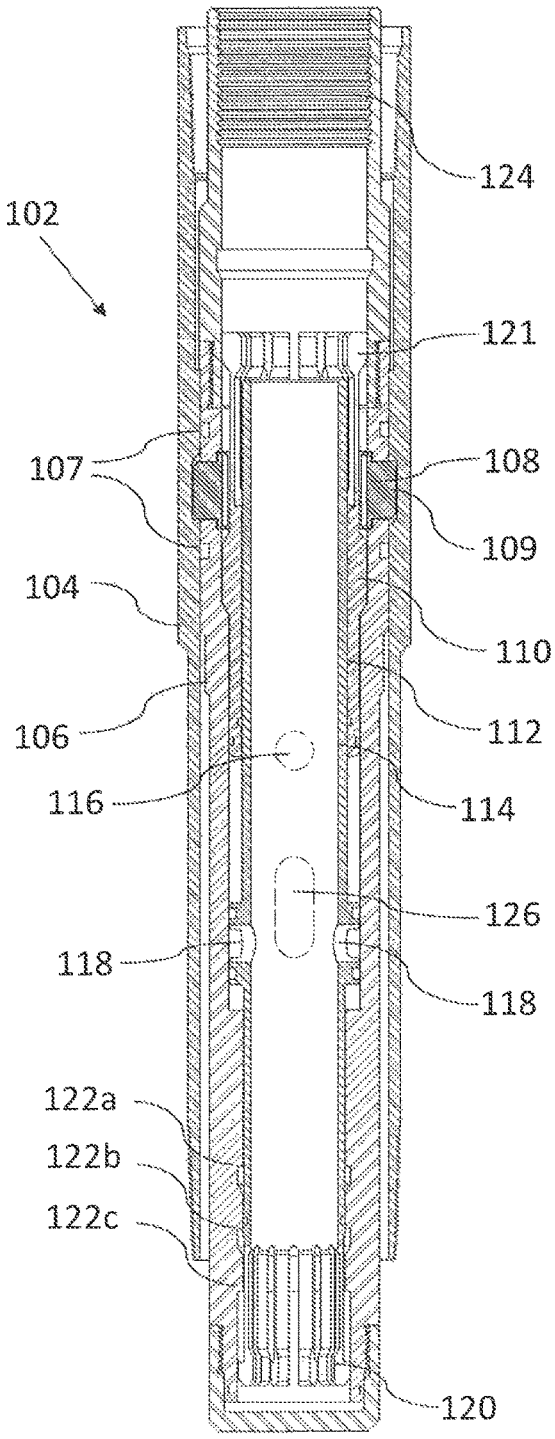
FIG. 15 is a side elevation view of a bridge plug prepared for removal.

Referring now to FIG. 13, once bridge plug 102 has been shifted to the sealed position and the installation of the liner completed, the tubing string used to install bridge plug 102 and tubing string may be withdrawn. In the depicted embodiment, second activation tubular 115 is also preferably withdrawn with the tubing string, which allows bridge plug 102 to be released at a later time. After second activation tubular 115 is removed, first activation tubular 114 is accessible and a downward force may be applied to shift first activation tubular 114 downward past shoulder 122*c*, as shown in FIG. 14. This causes ports 118 to align with equalization ports 126 in plugging element 106 and allow pressure to equalize above and below bridge plug 102. In addition, once first activation tubular 114 is shifted down, releasable collar 121 is free to be shifted out of engagement with groove 109 upon application of a sufficient force to allow inner sleeve 112 to also shift downward. As inner sleeve 112 shifts downward, dogs 108 will no longer held in place by shoulder 110 as shown in FIG. 15. Once dogs 108 are released, they will retract as an upward force is applied to plugging element 106, such that plugging element 106 is released to be taken to surface.

Figure 16:
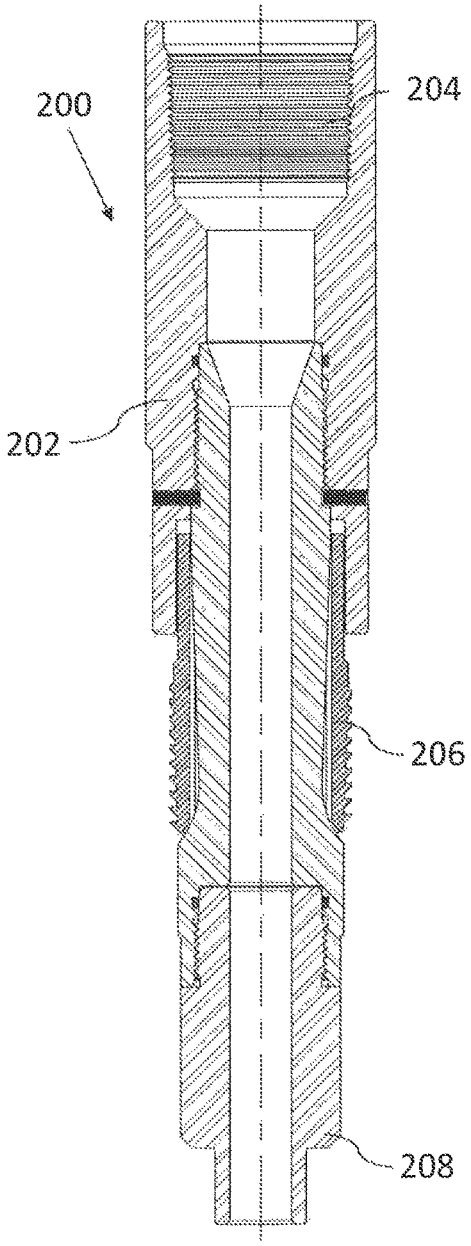
FIG. 16 is a side elevation view of a bridge plug removal tool.

Referring to FIG. 16, a bridge plug retrieval tool 200 that may be used to retrieve bridge plug 102 is shown. Bridge plug release tool 200 is intended to be used after second activation tubular 115 is withdrawn. Bridge plug retrieval tool 200 has a housing 202, a threaded connection 204 for connecting to a tubing string (not shown), an engagement surface 206, a shoulder 208, and an engagement surface 210. Shoulder 208 is sized to engage releasable collar 121. Downward force on bridge plug retrieval tool 200 causes releasable collar 121 to be pushed out of engagement with groove 109 and allows inner sleeve 112 to shift downward. Dogs 108 are then released, and threaded end 124 of plugging element 106 can then be engaged by engagement surface 206. In the depicted example, engagement surface 206 is a ratchet-type connection that ratchets into and engages threaded end 124 of bridge plug 102. Once bridge plug retrieval tool 200 engages with bridge plug 102 and dogs 108 are released, plugging element 106 may be removed from outer tubular body 104. As outer tubular body 104 preferably has an inner diameter that is the same as the liner, the removal of plugging element 106 allows full bore access to the liner.

Some advantages to using the approach described herein may include reducing the amount if rig time required, as only a single trip with tubing string 32 is used. Furthermore, by only using one trip, the wear and depreciation of tubing string 32 is also reduced, as the connections are only made up and broken once. There will also be less wear and depreciation on the handling equipment and drill line. Furthermore, as the pipe is handled less, the risk of injury to workers or environmental damage is reduced as there are fewer opportunities for errors to occur.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A method of installing a liner and a bridge plug in a hydrocarbon well, the hydrocarbon well comprising a first section having a casing and a second section below the first section, the second section comprising an open borehole, the method comprising the steps of:

providing a tubing string that carries a bridge plug and a liner setting tool, the liner setting tool carrying a liner;

simultaneously inserting the tubing string, the bridge plug, and the liner setting tool into the hydrocarbon well unto at least a portion of the liner extends into the second section of the hydrocarbon well;

after the liner has reached a desired position, activating the liner setting tool to install the liner such that at least a bottom of the liner is open to the second section of the hydrocarbon well;

activating the bridge plug to isolate the second section of the hydrocarbon well from a top end of the hydrocarbon well, wherein, when activated, the bridge plug is anchored relative to the hydrocarbon well within or above the liner; and disengaging the tubing string from the activated bridge plug and the activated liner.

2. The method of claim 1, wherein the tubing string comprises at least one internal valve that is open when the tubing string is inserted into the well.

3. The method of claim 1, wherein the liner comprises a liner top, the liner setting tool engaging the liner top.

4. The method of claim 3, wherein the liner top comprises a liner seal that seals between the outer surface of the liner and the casing.

5. The method of claim 3, wherein the liner top is activated by a liner top setting tool carried by the liner setting tool.

6. The method of claim 1, wherein the liner setting tool is hydraulically or mechanically operated.

7. The method of claim 1, wherein the bridge plug is activated by a bridge plug setting tool carried by the liner setting tool.

8. The method of claim 1, wherein the bridge plug is activated hydraulically or mechanically.

9. The method of claim 1, wherein the bridge plug is carried above the liner and engages the casing string when activated.

10. The method of claim 9, wherein the liner setting tool remains attached to the bridge plug after the bridge plug has been activated.

11. The method of claim 9, further comprising the step of disengaging the liner setting tool from the liner after activating the liner top and prior to activating the bridge plug.

12. The method of claim 4, wherein the bridge plug is carried within the finer and seals the liner when activated.

13. The method of claim 12, wherein the bridge plug is set inside the liner prior to inserting the tubing string into the hydrocarbon well, and comprises a valve that is open when the tubing string is inserted into the hydrocarbon well and closed when the liner setting tool is disconnected and withdrawn from the liner.

14. An apparatus for installing a liner and a bridge plug in a hydrocarbon well, the hydrocarbon well having an upper section comprising a casing and a lower section to be lined, the apparatus comprising:

a running tool having a tubing string attachment, a liner activator, and a bridge plug activator;

a liner carried by the running tool, the liner having a running state and a set state, the liner activator being adapted to selectively change the liner from the running state to the set state to install the liner in a desired Position in, the hydrocarbon well, wherein, in the set state, at least a bottom of the liner is open to the second section of the hydrocarbon well; and a bridge plug carried by the running tool adjacent to a top end of the liner, the running tool simultaneously carrying the bridge plug and the liner, the bridge plug having a running state and an activated state, the bridge plug activator being adapted to selectively change the bridge plug from the running state to the activated state to seal the hydrocarbon well above the liner setting tool, wherein, in the sealed state, the bridge plug is anchored relative to the hydrocarbon well and isolates fluids within the liner relative to a top end of the hydrocarbon well.

15. The apparatus of claim 14, wherein the tubing string attachment is selectively disconnectable.

16. The apparatus of claim 14, wherein the running tool comprises a tubular body that has at least one internal seal that is selectively operable.

17. The apparatus of claim 14, wherein the liner activator and the bridge plug activator are each either hydraulically or mechanically operated.

18. The apparatus of claim 14, wherein the liner comprises a liner top, the running tool engaging the liner top.

19. The apparatus of claim 18, wherein the liner top comprises a liner seal that seals between the outer surface of the liner and the casing.

20. The apparatus of claim 14, wherein the bridge plug is carried above the liner and engages the casing string in the sealed state.

21. The apparatus of claim 20, wherein the running tool remains attached to the bridge plug after the bridge plug has been changed to the sealed state.

22. The apparatus of claim 14, wherein the bridge plug is carried within the liner and seals the liner when changed to the sealed state.

23. The apparatus of claim 22, wherein the bridge plug is set against the liner prior to inserting the tubing string into the hydrocarbon well, and comprises a valve that is open when the tubing string is inserted into the hydrocarbon well and closed when the liner setting tool is disconnected and withdrawn from the liner.

24. The method of claim 1, wherein the bridge plug is adjacent to a top end of the liner.

25. The method of claim 1, further comprising the step of releasing and removing the bridge plug separately from the installed liner.

26. The method of claim 1, wherein the activated bridge plug prevents fluid flow through the liner toward the top end of the hydrocarbon well.

27. The method of claim 1, wherein the bridge plug is activated after the liner has been installed.

28. The apparatus of claim 14, wherein, in the sealed state, the bridge plug seals fluid below the bridge plug and within the liner.

* * * * *